US006257575B1

(12) United States Patent
Ortega

(10) Patent No.: US 6,257,575 B1
(45) Date of Patent: Jul. 10, 2001

(54) VERTICALLY ADJUSTABLE SQUARES ON A GAME BOARD ASSEMBLY

(76) Inventor: Herbert A. Ortega, 990 Piros Dr., Colorado Springs, CO (US) 80922

( * ) Notice: Subject to any disclaimer, the term of this patent is extended or adjusted under 35 U.S.C. 154(b) by 0 days.

(21) Appl. No.: 09/298,431

(22) Filed: Apr. 23, 1999

(51) Int. Cl.[7] ..... A63F 3/02

(52) U.S. Cl. ..... 273/241; 273/260; 273/287; 273/281; 273/284

(58) Field of Search ..... 273/241, 260, 273/289, 284, 281, 287

(56) References Cited

U.S. PATENT DOCUMENTS

| | | | | |
|---|---|---|---|---|
| 2,315,088 | * | 3/1943 | Pasquale | 273/281 |
| 3,266,724 | * | 8/1966 | Johnson | 273/281 |
| 3,891,219 | * | 6/1975 | Foerst | 273/281 |
| 5,082,287 | * | 1/1992 | Nwanna | 273/241 |
| 6,042,117 | * | 3/2000 | O'Brien | 273/281 |

* cited by examiner

*Primary Examiner*—Benjamin H. Layno
(74) *Attorney, Agent, or Firm*—Phillip A. Rein

(57) ABSTRACT

A plurality of vertically adjustable squares on a game board assembly having 1) a game board frame assembly provided with a bottom wall section and side wall sections defining an open cavity therebetween; and 2) a plurality of actuator square assemblies mounted within the open cavity of the support base assembly of the game board frame assembly. The bottom wall section has a plurality of actuator support openings therein to receive and support a respective one of the actuator square assemblies therein. Each actuator square assembly includes 1) a stationary block support assembly with a stationary tube member having a lower end anchored in the respective actuator support openings in the bottom wall section; 2) a movable support tube assembly mounted about the stationary tube member and being vertically movable thereof; and 3) a movable game square member secured to and supported on a respective one of the movable support tube assemblies. The movable support tube assembly has a movable tube member with an O-ring mounted therein and engageable against an outer surface of the stationary tube member to hold in a given vertically adjusted position. The movable game square member has an outer square shape and is mounted about the movable tube member for conjoint vertical movement therewith. Each movable game square member is provided with a top wall or game piece support surface operable to receive and support respective game pieces thereon. Each top wall can be moved vertically and independently to its own adjusted height between a lowermost or collapsed position to a maximum vertical position.

12 Claims, 3 Drawing Sheets

VERTICALLY ADJUSTABLE SQUARES ON A GAME BOARD ASSEMBLY

PRIOR ART

A patent search was conducted on the above identified invention and revealed the following United States patents:

| PATENT NO. | INVENTION | INVENTOR |
|---|---|---|
| Des. 236,993 | CHESS BOARD OR THE LIKE | Howard C. Davis |
| 3,434,719 | CHECKER-TYPE BOARD GAME APPARATUS | Robert V. Fyanes |
| 3,531,123 | CHECKERBOARD WITH RECESSED SQUARES AND PIECES DISPOSABLE THEREIN | David M. Peebles |
| 3,767,201 | MULTI-LEVEL GAME BOARD STRUCTURE FOR THREE-DIMENSIONAL CHESS AND CHECKER GAMES | Harper et al |
| 3,843,133 | GAME APPARATUS FOR PLAYING AND RECORDING SUCCESSIVE PLAYS IN A GAME | Paul D. Brown |
| 3,871,657 | MULTILEVEL CHESS OR CHECKER BOARD | Lorenz et al |
| 4,179,127 | THREE DIMENSIONAL CHESS GAME APPARATUS | Vernon T. Goodman |
| 4,348,027 | MULTI-LEVEL GAME BOARD APPARATUS | Ricardo Escamilla-Kelly |
| 4,411,433 | BOARD GAME APPARATUS | William M. Flynn |
| 5,031,917 | THREE DIMENSIONAL CHESS GAME | Leonard M. Greene |
| 5,662,329 | CHESS-TYPE GAME | Richard L. Nason |

The only pertinent reference is Lorenz et al which discloses a multilevel chess or checker board enabling participants of the conventional games of chess and checkers to vary the topography of the board prior to the commencement of the game. However, the various supporting pieces 7 are of a fixed height and not independently adjustable.

PREFERRED EMBODIMENT OF THE INVENTION

In one preferred embodiment of this invention, vertically adjustable squares on a game board assembly are utilized with a plurality of independent squares (a total of 64 squares) on which respective game pieces are placed thereon, such in a game of checkers, chess, or the like. In a standard game board assembly, we have shown herein a total of 64 independently adjustable squares, each having a top surface respectively to receive a game piece thereon.

More particularly, the vertically adjustable squares on a game board assembly of this invention includes 1) a game board frame assembly; and 2) an actuator square assembly, being a plurality thereof, mounted on the game board frame assembly and each one being vertically adjustable in height independently.

The game board frame assembly includes a support base assembly supported on a frame support assembly on a support surface, such as a card table or the like.

The support base assembly includes a bottom wall section having connected to an outer periphery thereof, a plurality of side wall sections so as to present a square frame having an upper area surrounded by the side wall sections forming a cavity to receive and confine adjacent and abutting actuator square assemblies therein.

The bottom wall section is generally constructed of a wood material but could be marble and has a plurality of actuator support openings or holes to receive a portion of the respective ones of the actuator square assemblies therein as will be noted.

The frame support assembly includes a support block mounted to an undersurface in each corner of the bottom wall section and having thereon a support ball used to contact a supporting surface to achieve an attractive appearance.

Each of the actuator square assemblies, being a total of 64 thereof, includes 1) a stationary block support assembly anchored to respective ones of the actuator support holes or openings in the bottom wall section of the support base assembly; 2) a movable support tube assembly connected to the respective stationary support block assemblies and vertically movable thereon; and 3) a movable game square member which is mounted about and movable with the movable support tube assembly.

Each stationary block support assembly includes a stationary tube member having 1) a top flared section; 2) a mid support section; and 3) a lower connector section.

The stationary tube member is of a cylindrical shape having a top flared section with an outer contact edge thereon for contacting a portion of the movable support tube assembly as will be noted.

The lower connector section includes an outer groove and an upper groove. The outer groove is adapted to receive a snap ring member therein to hold a washer member against a lower outer surface of the bottom wall section of the support base assembly.

The upper groove is operable to receive an anchor snap ring member therein and to be placed against an upper surface of the bottom wall section of the support frame assembly so as to hold the entire stationary tube member in a rigid clamped condition about opposite surfaces of the bottom wall section.

The movable support tube assembly includes a generally cylindrical movable tube member having an interior diameter slightly larger than the exterior diameter of the outer contact edge of the top flared section of the stationary tube member of the stationary block support assembly.

The movable support tube assembly includes 1) the movable tube member; 2) an upper washer member; and 3) an O-ring member.

The movable tube member has an upper flange and a lower flange with both flanges extended inwardly. The upper washer member is mounted against and connected to the upper flange when in the assembled condition.

As noted in FIG. 4, the O-ring member is mounted against an upper surface of the lower flange and provides a friction type seal between the stationary tube member and an inner surface of the movable tube member. The O-ring member insures that the movable tube member moves in a controlled and aligned manner about the stationary tube member in a common longitudinal axis.

The movable game square member can be constructed of an attractive hard wood material such as oak or walnut or may be constructed of a marble material.

Each movable game square member includes a main block member of square shape having a top wall, outer side walls, a central support opening, and a bottom entrance opening.

The inside central support opening is of a size to snugly fit over, enclose, and receive the movable tube member of the movable support tube assembly therein and is conjointly vertically movable therewith.

As noted in FIG. 5, the bottom wall section is provided with a plurality of the actuator support openings to receive a respective one of the actuator square assemblies therein.

The movable support tube assembly and the movable game square member could be a one-piece construction known as a movable game piece support assembly.

Also, as noted in FIG. 3, the movable game square members are in snug, adjacent relationship with a respective adjacent one of the movable game square members and are independently movable vertically as noted in FIG. 3 to a height that the user would desire.

It is noted that a pencil or an actuator rod can be inserted through a control opening into the lower connector section of the stationary tube member so as to be pressed against an inner surface of the upper washer member of the movable support tube assembly to get the desired vertical positioning and height thereof. Of course, a mere depression on a top game piece support surface of the main block member of the respective movable game square members can move the same downwardly to any desired height.

OBJECTS OF THE INVENTION

One object of this invention is to provide for vertically adjustable squares on a game board assembly to create added versatility and excitement while playing a game of checkers or chess or any other such game requiring a plurality, such as a total of 64, of independently vertically adjustable squares.

Another object of this invention is to provide for vertically adjustable squares on a game board assembly being of quality construction; attractive in appearance; and providing means thereon for independently adjusting the height of the game board squares, such as from a lowered flat flush surface to a "maximum" raised height of two and one quarter inches but this could height could be varied.

One other object of this invention is to provide for vertically adjustable squares on a game board assembly having a game board frame assembly with a bottom wall section and upwardly extended side wall sections to form a central cavity area operable to receive a plurality of actuator square assemblies, each having a movable game square member that can be independently vertically adjustable with the use of an actuator rod.

A further object of this invention is to provide for vertically adjustable squares on a game board assembly having a plurality of actuator square assemblies, each having 1) a stationary block support assembly; 2) a movable support tube assembly mounted about a respective stationary block support assembly being vertically adjustable; and 3) a movable game square member mounted about respective ones of the movable support tube assemblies so as to be slidably and vertically adjustably relative to respective ones of the stationary block support assemblies.

Still, one other object of this invention is to provide for vertically adjustable squares on a game board assembly which is economical to manufacture; and substantially maintenance free while providing a new element in the playing of a game of checkers, chess, or the like.

Various other objects, advantages, and features of the invention will become apparent to those skilled in the art from the following discussion, taken in conjunction with the accompanying drawings, in which:

FIGURES OF THE INVENTION

Figure 4:
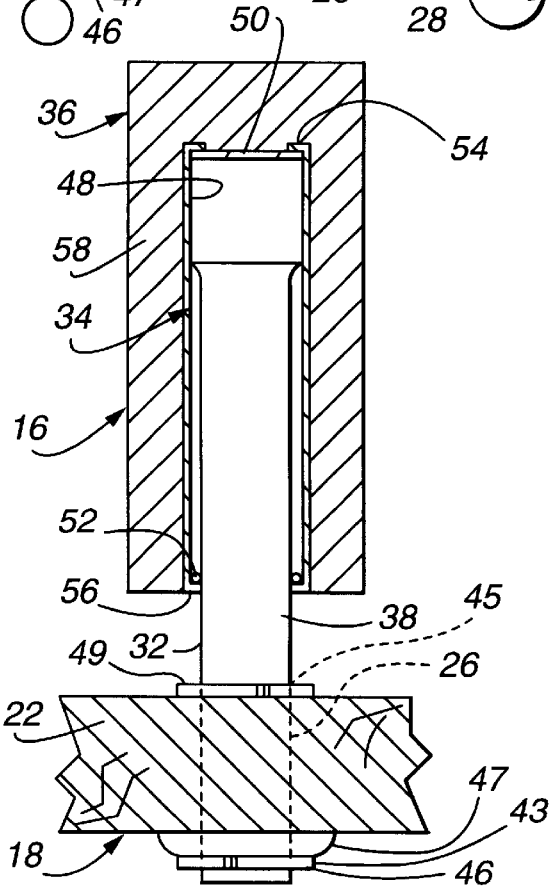
Figure 5:
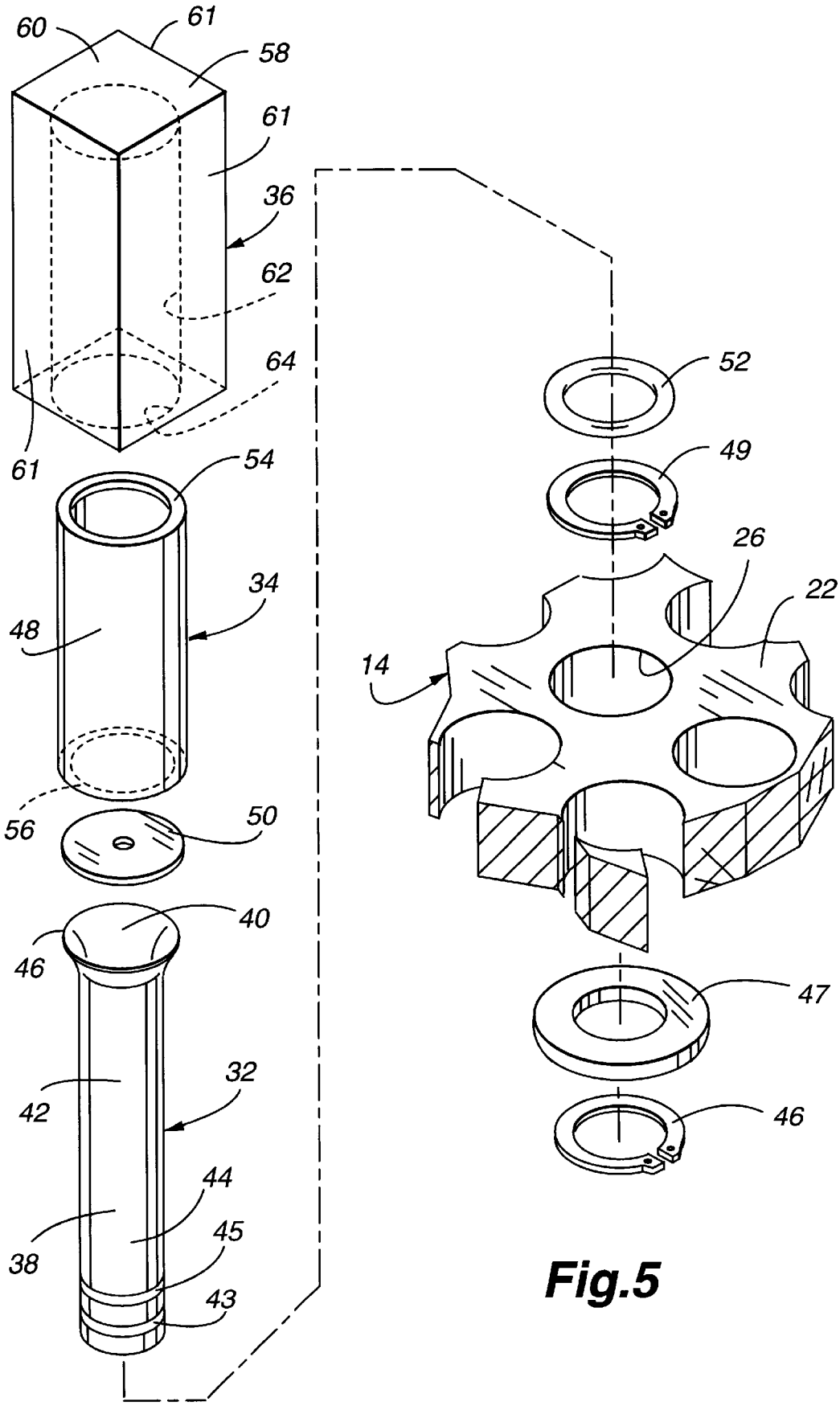

FIG. 4 is an enlarged sectional view of a portion of a game board frame assembly and an actuator square assembly of the vertically adjustable squares on a game board assembly of this invention; and FIG. 5 is an exploded perspective view of the actuator square assembly as attached to a bottom wall section of the game board frame assembly of the vertically adjustable squares on a game board assembly of this invention.

The following is a discussion and description of preferred specific embodiments for vertically adjustable squares on a game board assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 1:
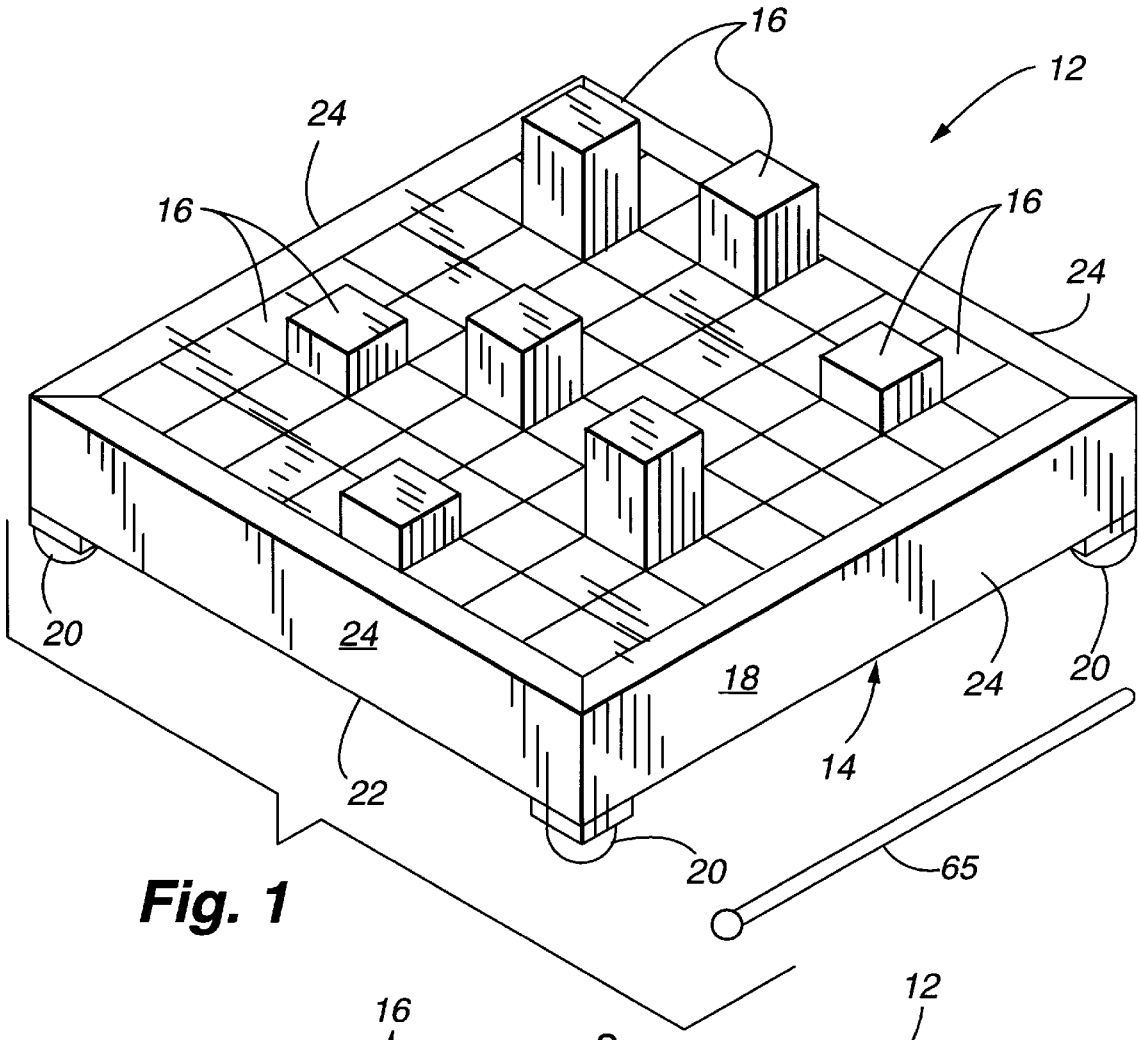
FIG. 1 is a perspective view of the vertically adjustable squares on a game board assembly of this invention.
Figure 2:
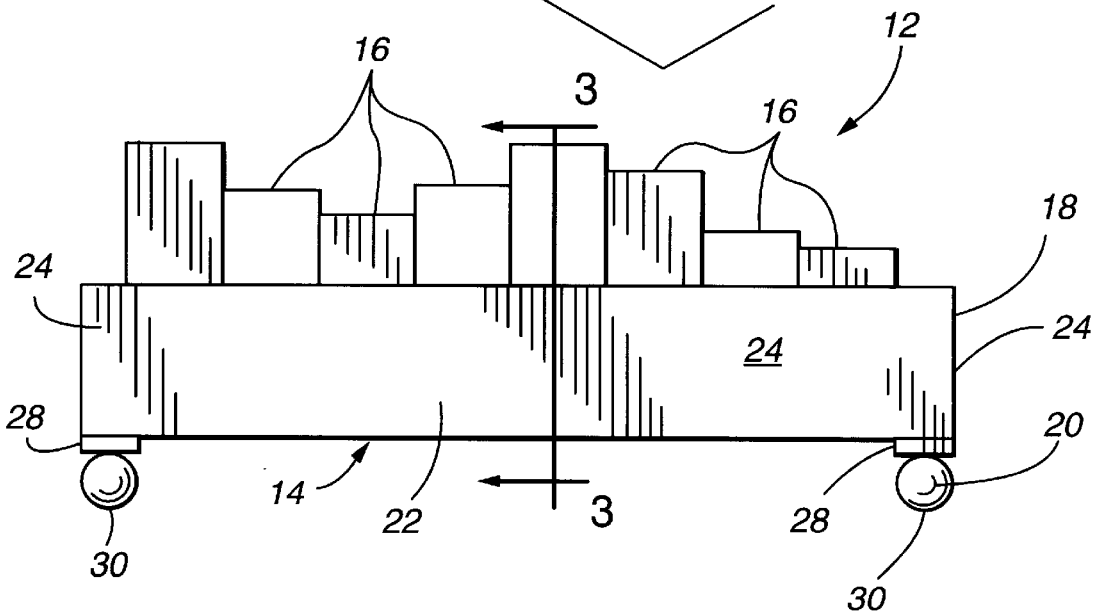
FIG. 2 is a side elevational view of the vertically adjustable squares on a game board assembly of this invention.

On referring to the drawings in detail and, in particular to FIG. 1, vertically adjustable squares on a game board assembly of this invention, indicated generally at 12, is providing a game board frame assembly 14 having mounted thereon a plurality of independently adjustable actuator square assemblies 16.

A top wall or game piece support surface of each actuator square assembly 16 is adapted to receive a game piece thereon such as the circular pieces used in a game of checkers or the various game pieces utilized in a game of chess.

The game board frame assembly 14 includes a support base assembly 18 mounted on a frame support assembly 20.

The support base assembly 18 has a bottom wall section 22 of a generally square shape having side wall sections 24 extended upwardly from outer peripheral portions of the bottom wall section 22.

The bottom wall section 22 and side wall sections 24 can be constructed of a unique hardwood such as oak or walnut or could be a marble composition so as to be attractive in appearance. Further, the bottom wall section 22 and the side wall sections 24 could be of an integral, one-piece construction.

Figure 3:
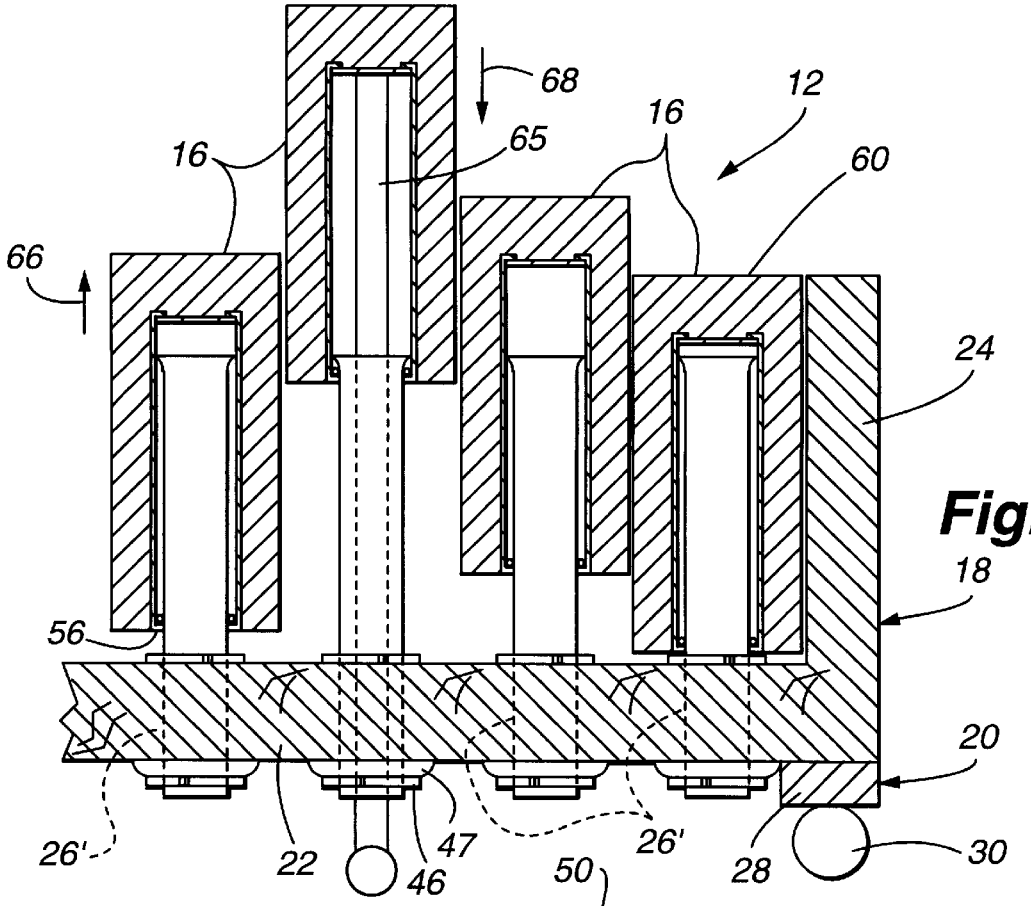
FIG. 3 is a fragmentary sectional view taken along line 3—3 in FIG. 2.

The bottom wall section 22 is provided with a plurality of actuator support openings or holes 26 to receive respective ones of a portion of the actuator square assembly 16 therein as best noted in FIGS. 3 and 4.

The frame support assembly 20 includes a support block 28 mounted at each corner of the bottom wall section 22 and having a support ball 30 connected thereto. The support ball 30 gives an attractive appearance for supporting the entire game board frame assembly 14 on a support surface such as a card table or the like.

Each actuator square assembly 16 includes 1) a stationary block support assembly 32 anchored to the bottom wall section 22 of the support base assembly 18 as will be explained; 2) a movable support tube assembly 34 mounted about a respective one of the stationary block support assemblies 32; and 3) a movable game square member 36 mounted about a respective one of the movable support tube assemblies 34 and vertically movable conjointly therewith.

The stationary block support assembly 32 includes a stationary tube member 38 having 1) a top flared section 40;

2) a mid support section 42; and 3) a lower connector section 44. The entire stationary tube member 38 resembles a hollow cylindrical tube or pipe member.

The top flared section 40 has an outer contact edge 46 engageable with an inner portion of the movable support tube assembly 34 as will be explained.

The lower connector section 44 is provided with an outer groove 43 and an upper groove 45. The outer groove 43 is to receive a snap ring member 46 therein and to hold a washer member 47 against an outer bottom surface of the bottom wall section 22 of the base support assembly 18 in the assembled condition. (FIG. 4).

The upper groove 45 is to receive an anchor snap ring member 49 therein so as to provide a firm clamping against upper and lower surfaces of the bottom wall section 22 in order to firmly support the stationary tube member 38 as noted in FIG. 4.

As best noted in FIGS. 4 and 5, the movable support tube assembly 34 includes 1) a movable tube member 48; 2) an upper washer member 50 secured to an inner portion of the movable tube member 48; and 3) an O-ring member 52 to be placed into engagement with an outer surface of the stationary tube member 38 and an inner surface of the movable tube member 48.

The movable tube member 48 is provided with an upper flange 54 and a lower flange 56. The upper washer member 50 is secured as by welding or an adhesive to a lower surface of the upper flange 54 as noted in FIG. 4.

The O-ring member 52 in the assembled condition is adapted to be placed about the outer surface of the stationary tube member 38 and engages an inner surface of the movable tube member 48 and against an inner, upper surface of the lower flange 56 so as to assure that each of the movable game square members 36 are movable along a vertical longitudinal axis.

For a feasible method of construction, the upper washer member 50 and the O-ring member 52 are first assembled with the lower flange 56 being created as a final step in the assembled condition of the movable support tube assembly 34.

Also, the O-ring member 52 operates as a functionally engageable means to hold each of the respective actuator square assemblies 16 in a vertically adjusted position as will be explained.

Each movable game square member 36 can be constructed of an attractive hard wood material such as oak or walnut or may be constructed of a marble material.

Each movable game square member 36 includes a main block member 58 of a rectangular square shape having a top wall or game piece support surface 60 integral with outer side walls 61 and having a central support opening 62 therein leading to a bottom entrance opening 64.

The central support opening 62 is of a size to snugly receive the respective movable tube member 48 of the movable support tube assembly 34 therein.

The depth of the central support opening 62 is of a size substantially equal to the length of the movable tube member 48 as clearly noted in FIG. 4.

A bottom surface of the movable game square member 36 is adapted to rest against the anchor snap ring member 49 and having the top wall 60 in horizontal alignment (when in a fully collapsed position) with the top walls of the side wall sections 24 of the support base assembly 18 as noted in FIGS. 1 and 3.

It is noted that the movable game square member 36 and the movable tube member 48 could be a one-piece construction known as a movable game piece support assembly 37 if so desired.

Further, an actuator rod member 65 can be provided to move the respective movable game piece support assemblies 37 to an elevated position.

Clips could be added to a bottom surface of the bottom wall section 22 to support and store the actuator rod member 65 thereon.

USE AND OPERATION OF THE INVENTION

In the use and operation of the vertically adjustable squares on a game board assembly 12 of this invention, a plurality of the actuator square assemblies 16 are independently and vertically adjustable relative to the game board frame assembly 14.

As noted in FIG. 1, it is illustrated that a total of seven (7) of the actuator square assemblies 16 are vertically adjustable to various heights.

It is obvious that all of the actuator square assemblies 16 can be independently adjustable to a lowermost or collapsed position as shown by the right handed one of the actuator square assemblies 16 in FIG. 3. In this condition, the top walls 60 of the main block members 58 lie in a common horizontal plane with the top edges of the side wall sections 24 so as to resemble a normal game board member.

As noted in FIG. 3, it is obvious that the actuator rod member 65 or a pencil member can be inserted through the central opening 51 in the stationary tube member 38. An outer end of the actuator rod member 65 would abut an inner surface of the upper washer member 50 in the movable support tube assembly 34. Next, pressure is applied to the actuator rod member 65 to move the interconnected movable support tube assembly 34 and movable game square member 36 vertically as noted by an arrow 66 in FIG. 3. In this manner, each one of a total of 64 of the movable support tube assemblies 34 and its interconnected movable game square member 36 can be movable from a lowermost or collapsed position noted at the right hand actuator square assembly 16 in FIG. 3 to a maximum vertical height as shown by the actuator square assembly 16 being a second one over from the left as noted in FIG. 3. Each of the actuator square assemblies 16 can be independently adjustable between these two upper and lower limits of movement.

Further, it is obvious that each of the actuator square assemblies 16 can be moved downwardly from their vertically adjustable or elevated positions by applying some pressure against the top wall or game piece support surface 60 of the respective movable game square members 36.

It is noted that each of the adjustable and movable game square members 36 are held in a given adjusted position by a frictional contact or means of the respective O-ring members 52 between the inner surface of the respective, interconnected movable tube member 48 and the outer surface of the respective stationary tube member 38.

While the invention has been described in conjunction with preferred specifc emobidments thereof, it will be understood that this description is intended to illustrate and not to limit the scope of the invention, which is defined by the following claims:

I claim:

1. A game board assembly having a vertically adjustable square, comprising:

a) a game board frame assembly;

b) an actuator square assembly having a first portion thereof secured to said game board frame assembly;

c) said actuator square assembly includes a second portion slidably and movably mounted on said first portion, and a third portion secured to said second portion having a game piece support surface thereon;

d said first portion having a stationary tube member with a lower connector section secured to said game board frame assembly and having a central opening therethrough;

e) said second portion includes a movable support tube assembly having a movable tube member of cylindrical shape being telescopingly mounted over said stationary tube member and being movable axially and laterally relative to said stationary tube member;

f) said third portion having a movable game square member telescopingly mounted on said movable tube member and axially movable therewith; and g) said movable game square member having an outer game piece support surface thereon to receive a game piece member thereon and said game piece support surface is movable axially on said stationary tube member to provide said game piece support surface at a selected and variably adjusted height relative to said game board frame assembly;

whereby said second portion is longitudinally movable on said first portion to place said game piece support surface at preselected adjustable elevations to support a game piece thereon.

2. A game board assembly as described in claim 1, wherein:

a) a plurality of said actuator square assembly are provided being supported on said game board frame assembly and having said game piece support surfaces movable vertically independently to place all of them in the same plane or all in different horizontal and parallel planes for supporting the respective game pieces thereon.

3. A game board assembly as described in claim 1, wherein:

a) a bottom portion of said stationary tube member having an entrance opening therein to receive an actuator rod member therethrough;

b) said movable tube member having a central opening therein placed about said stationary tube member; and c) said movable tube member having an upper flange with a washer member secured thereto operable to receive an outer end of said actuator rod member thereagainst;

whereby said actuator rod member is inserted through said stationary tube member and said movable tube member to engage said upper washer member as a means to readily move respective ones of said movable tube members axially and laterally from said game board frame assembly and each of said game piece support surfaces can be movable by a person's finger to move the respective said game piece support surfaces downwardly into a lower elevated adjusted position.

4. A game board assembly as described in claim 1, wherein:

a) said movable support tube assembly includes an O-ring member mounted about said stationary tube member and contacting said movable tube member to form a friction means to hold said movable support tube in a predetermined adjusted position.

5. A game board assembly having a plurality of vertically adjustable squares to respectively support a game piece such as a chess game player piece thereon, comprising:

a) a game board frame assembly including a support base assembly having a bottom wall section with upwardly extended side wall sections to form a cavity therebetween;

b) an actuator square assembly including a stationary block support assembly having one end secured to said bottom wall section; and a movable game piece support assembly slidably mounted and axially movable on said stationary block support assembly; c) said movable game piece support assembly having a game piece support surface to receive and support a respective game piece thereon;

d) said bottom wall section having an actuator support opening therein to receive and secure one end of said stationary block support assembly having a central opening therethrough;

e) said movable game piece support assembly having a movable tube member of cylindrical shape having an entrance opening therein placed about and supported on said stationary block support assembly; and f) said movable tube member having an abutment member secured at a top edge thereof to receive a portion of an actuator rod thereagainst for moving said movable game piece support assembly to a selected and individually adjustable position to place said game piece support surface at a desired elevated position relative to said bottom wall section.

whereby said movable game piece support assembly is selectively and independently movable relative to said bottom wall section to place said game piece support surface at a selected and adjustable height relative to said bottom wall section.

6. A game board assembly as described in claim 5, wherein:

a) said movable game piece support assembly includes an O-ring member mounted about said stationary block support assembly and engageable with a portion of said movable game piece support assembly so as to provide a means for holding said movable game piece support assembly in a given adjusted position.

7. A game board assembly as described in claim 5, including:

a) an actuator rod member of a size to be inserted within an opening in said stationary block support assembly and said movable game piece support assembly so as to readily move said movable game piece support assembly by said actuator rod to a given desired adjusted position relative to said support base assembly.

8. A game board assembly as described in claim 5, wherein:

a) said stationary block support assembly includes a stationary tube member having a connector section with upper and lower grooves; and b) said upper and lower grooves operable to receive a respective snap ring member thereon to clamp said bottom wall section therebetween to hold said stationary tube member in a rigid condition.

9. A plurality of vertically adjustable squares on a game board assembly whereby each square is adapted to support a game piece thereon, comprising:

a) a support base member normally held in a horizontal plane for playing a game of checkers or chess thereon;

b) a stationary member having one end secured to said support base member and extended upwardly therefrom;

c) a movable game piece support assembly slidably mounted on said stationary member and having an outer game piece support surface operable to receive and support a game piece thereon;

d) said movable game piece support assembly selectively and independently movable on said stationary member to place said game piece support surface in spaced horizontal planes relative to said support base member;

e) said support base member having an opening therein to receive and support said stationary member therein;

f) said stationary member being a cylindrical tube member having an opening therethrough; and g) said movable game piece support assembly including a movable tube member having an open end slidably mounted about said stationary tube member so as to be movable axially thereon to place said game piece support surface at a desired adjustable height relative to said support base member.

10. A game board assembly as described in claim 9, wherein:

a) said movable game piece support assembly includes a friction member mounted about said stationary tube member and engageable with an inner surface of said movable tube member to hold said movable game piece support assembly in a desired adjusted position which would require substantial pressure thereagainst to move from one adjusted position to another.

11. A game board assembly as described in claim 10, wherein:

a) said friction member, being an O-ring member, which can be slightly compressed between said stationary tube member and said movable tube member to provide desired resistance to axial movement of said movable game piece support assembly.

12. A game board assembly as described in claim 9, including:

a) an actuator rod member to be inserted through a central opening in said stationary member and engageable with a portion of said movable game piece support assembly so as to move same vertically outwardly from said support base member to an adjusted vertical position;

whereby a user of said game board assembly can utilize one's fingers to move a respective said movable game piece support assembly downwardly towards said support base member by applying pressure to said respective one of said game piece support surface.

* * * * *